United States Patent [19]

Schwellinger et al.

[11] Patent Number: 4,525,326

[45] Date of Patent: Jun. 25, 1985

[54] ALUMINUM ALLOY

[75] Inventors: Pius Schwellinger, Lottstetten, Fed. Rep. of Germany; Alois Ried, Schaffhausen, Switzerland; Jürgen Timm, Steisslingen; Manfred Heckler, Singen, both of Fed. Rep. of Germany

[73] Assignee: Swiss Aluminium Ltd., Chippis, Switzerland

[21] Appl. No.: 524,412

[22] Filed: Aug. 18, 1983

[30] Foreign Application Priority Data

Sep. 13, 1982 [CH] Switzerland ..... 5413/82

[51] Int. Cl.[3] ..... C22C 21/02

[52] U.S. Cl. ..... 420/535; 148/415; 148/418; 148/439; 148/440; 420/544

[58] Field of Search ..... 420/535, 544, 543; 148/11.5 A, 12.7 A, 415, 418, 439, 440

[56] References Cited

U.S. PATENT DOCUMENTS 4,094,705 6/1978 Sperry et al. ..... 148/11.5 A

*Primary Examiner*—R. Dean

*Attorney, Agent, or Firm*—Bachman and LaPointe

[57] ABSTRACT

0.05 to 0.2% vanadium and manganese in a concentration equal to $\frac{1}{4}$ to $\frac{2}{3}$ of the iron concentration are added to an aluminum wrought alloy containing 0.3–1.0% Mg, 0.3–1.2% Si, 0.1–0.5% Fe and up to 0.4% Cu. This alloy is employed mainly for the manufacture of extruded products.

12 Claims, No Drawings

ALUMINUM ALLOY

BACKGROUND OF THE INVENTION

The invention relates to aluminum alloys which contain magnesium and silicon in the general range 0.3–1.0 wt.% magnesium and 0.3–1.2 wt.% silicon. Such heat-treatable alloys are utilized in most of the manufacturing processes used with aluminum alloys for example for manufacturing extruded, rolled and hot formed parts. Such products can be subjected to a heat treatment to achieve higher strength values. The silicon and magnesium contents are selected according to the strength desired likewise the concentrations of other alloying elements; for example up to 1.0% manganese, up to 1% copper or up to 0.35% chromium is added. It is also known to make vanadium additions in particular to reduce the quench sensitivity of extruded products. This makes it possible to dispense with water cooling after extrusion without having to accept a penalty in terms of strength.

All these measures employed to achieve a certain strength level are taken at the expense of one or more other desireable properties such as toughness, bendability, resistance to corrosion and, in particular in the case of extruded products, uniform surface, absence of die pick-up, good longitudinal weld seams, possibility to extrude complicated sections and implementation of economic extrusion rates.

SUMMARY OF THE INVENTION

In view of these difficulties encountered in selecting an alloy which is satisfactory in all respects, the object of the present invention is to find for the range of heat-treatable AlMgSi alloys such alloy additions which make it possible to produce, for all strength levels and via the normal fabrication routes, products which satisfy the many different requirements.

This object is achieved by way of the invention in that 0.05% to 0.20% vanadium, and manganese at a concentration of $\frac{1}{4}$ to $\frac{2}{3}$ of the iron content, are added to aluminum alloys containing 0.3 to 1.0% Mg, 0.3 to 1.2% Si, 0.1 to 0.5% Fe and at most 0.4% Cu.

These additions have the effect that after a hot forming treatment or solution anneal these alloys have a fine-grained recrystallized structure and the iron-bearing particles are more favorably distributed. Both properties give rise to many advantages in terms of the behavior of the alloys according to the invention.

The fine-grained, recrystallized state brought about mainly as a result of the vanadium content increases the cold formability of rolled and extruded products. Furthermore it contributes to more uniform materials properties and increases the strength level in comparison with coarse recrystallized structures. In addition better all-round extrudability is obtained.

DETAILED DESCRIPTION

Manganese which is present in a concentration equal to $\frac{1}{4}$ to $\frac{2}{3}$ of the iron concentration forms, together with aluminum, silicon and iron, quaternary phases which, due to their dimensions and distribution, considerably increase the toughness of the material. In this respect a manganese/iron ratio of $\frac{2}{3}$–$\frac{1}{2}$ has been found to be particularly favorable.

Iron concentrations below 0.25% have been found to be particularly suitable for avoiding the tendency for edge cracking and die pick-up during extrusion.

If a particularly high ductility is required, cobalt can be added in an amount equal to $\frac{1}{4}$ to $\frac{1}{2}$ of the amount (wt.%) of iron present. Brittleness is prevented by the shape and distribution of the quaternary phases formed by Al, Co, Fe and Mn. Also the extrudability is improved further. If the concentration of manganese or cobalt lies above a given limit, however, the extrudability is again reduced. substantially increasing the force required for hot forming, should not exceed 0.25% if susceptibility to corrosion is particularly to be avoided.

In the following examples, alloys (E) according to the invention were compared with conventional alloys (H) of approximately the same strength:

| Code | Type | Si | Fe | Cu | Mn | Mg | V |
|---|---|---|---|---|---|---|---|
| 1 H | AlMgSi 0.5; AA 6060 | .55 | .21 | .02 | .03 | .55 | — |
| 1 E | | .39 | .19 | .17 | .06 | .51 | .08 |
| 2 H | AlMgSi 0.8; AA 6005 A | .62 | .21 | .17 | .06 | .55 | — |
| 2 E | | .60 | .21 | .17 | .06 | .55 | .10 |
| 3 H | AlMgSi 1.0; AA 6082 | 1.00 | .20 | .05 | .90 | .77 | — |
| 3 E | | .81 | .19 | .18 | .06 | .60 | .09 |
| 4 H | AlMgSi 1.0; AA 6082 | 1.00 | .20 | .05 | .90 | .77 | — |
| 4 E | | .78 | .21 | .17 | .06 | .60 | .09 |
| 5 H1 | AlMgSi 1.0; AA 6081 | 1.00 | .25 | .03 | .35 | .77 | — |
| 5 H2 | AA 6009 | .80 | .25 | .35 | .50 | .60 | — |
| 5 E | | .79 | .21 | .16 | .08 | .51 | .10 |

Alloys 1 to 3 were processed to extruded products. The alloys (E) according to the invention differed from the conventional alloys (H) by the superior bendability of the former after artificial age hardening of the sections.

Alloys 4 were processed to forged parts. The hot formability of 4 E was substantially better than that of 4 H. While the artificially age hardened forging of alloy 4 H exhibited pronounced coarse grain and could not be anodized for decorative purposes, and at the same time exhibited non-uniform and locally low strength values, the part made from alloy 4 E had a very fine grain structure.

Alloy 5 was processed into sheet and subjected to a shaping operation before artificial age hardening. Sheet 5 E exhibited the better values both with respect to deep drawability and toughness.

What is claimed is:

1. Heat-treatable aluminum base alloy consisting essentially of 0.3–1.0% magnesium, 0.3–1.2% silicon, 0.1–0.5% iron, up to 0.4% copper, 0.05–0.20% vanadium, a manganese content equal to $\frac{1}{4}$ to $\frac{2}{3}$ of the concentration of iron, and the balance essentially aluminum.

2. Aluminum alloy according to claim 1 including a cobalt content equal to $\frac{1}{4}$ to $\frac{1}{2}$ of the concentration of iron.

3. Aluminum alloy according to claim 1 wherein the vanadium content is 0.06 to 0.14%.

4. Aluminum alloy according to claim 1 wherein the manganese content is equal to $\frac{1}{3}$ to $\frac{1}{2}$ of the iron content.

5. Aluminum alloy according to claim 1 containing 0.15–0.25% iron.

6. Aluminum alloy according to claim 1 containing 0.10 to 0.25% copper.

7. Aluminum alloy according to claim 1 wherein said alloy after hot forming is characterized by a fine-grained recrystallized structure and a favorable distribution of iron-bearing particles.

8. Aluminum alloy according to claim 1 wherein said alloy includes quaternary phases of manganese, iron, silicon and aluminum which increase toughness.

9. Heat-treatable aluminum base alloy extruded product consisting essentially of 0.3–1.0% magnesium, 0.3–1.2% silicon, 0.1–0.5% iron, up to 0.4% copper, 0.05–0.20% vanadium, a manganese content equal to $\frac{1}{4}$ to $\frac{2}{3}$ of the concentration of iron, and the balance essentially aluminum.

10. Extruded product according to claim 9 including a cobalt content equal to $\frac{1}{4}$ to $\frac{1}{2}$ of the concentration of iron.

11. Extruded product according to claim 9 wherein said alloy after hot forming is characterized by a fine-grained recrystallized structure and a favorable distribution of iron-bearing particles.

12. Extruded product according to claim 9 wherein said alloy includes quaternary phases of manganese, iron, silicon and aluminum which increase toughness.

* * * * *